United States Patent [19]

Grondin

[11] 4,432,296

[45] Feb. 21, 1984

[54] APPARATUS AND METHOD FOR REDUCING WASTE IN TUFTING

[76] Inventor: Edward A. Grondin, 7 Hiawatha Dr., Greenville, S.C. 29615

[21] Appl. No.: 366,082

[22] Filed: Apr. 6, 1982

[51] Int. Cl.[3] ..... D05C 15/00

[52] U.S. Cl. ..... 112/266.2; 28/113; 28/159; 112/147; 112/79 R

[58] Field of Search ..... 112/141, 423, 266.1, 112/266.2, 7, 143, 147, 79 R; 28/113, 159

[56] References Cited

U.S. PATENT DOCUMENTS 3,783,805 1/1974 Guichard ..... 112/147

3,848,435 11/1974 Armstrong ..... 112/147 X 4,173,192 11/1979 Schmidt et al. ..... 112/79 R 4,187,586 2/1980 Semjonow ..... 28/112

*Primary Examiner*—Ronald Feldbaum

*Attorney, Agent, or Firm*—Ralph Bailey

[57] ABSTRACT

Apparatus and method of tufting are disclosed wherein the edges of carpet backing and the like are folded to assure presenting a desired width of backing to the tufting needles in proper position thus avoiding the necessity for making an excessive width of carpet in order to assure an adequate usable width of finished carpet thereby avoiding waste.

11 Claims, 4 Drawing Figures

Fig. 1.
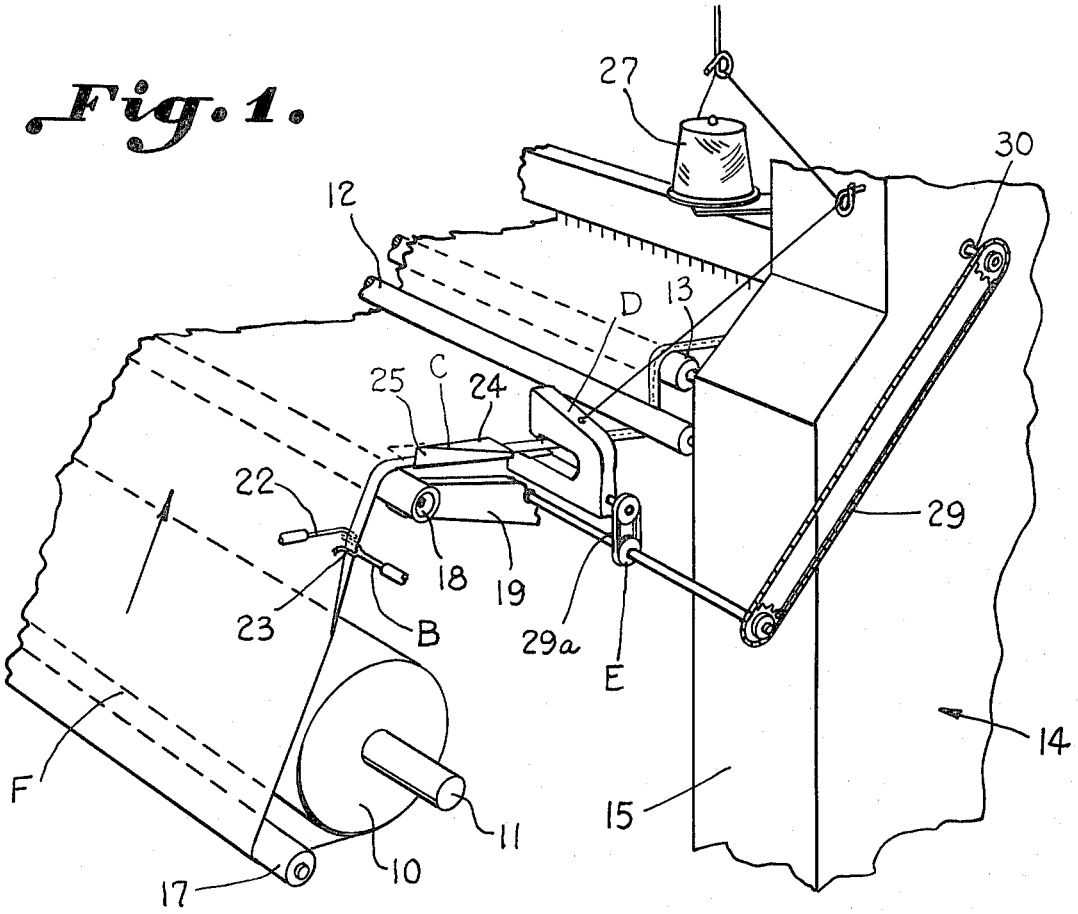
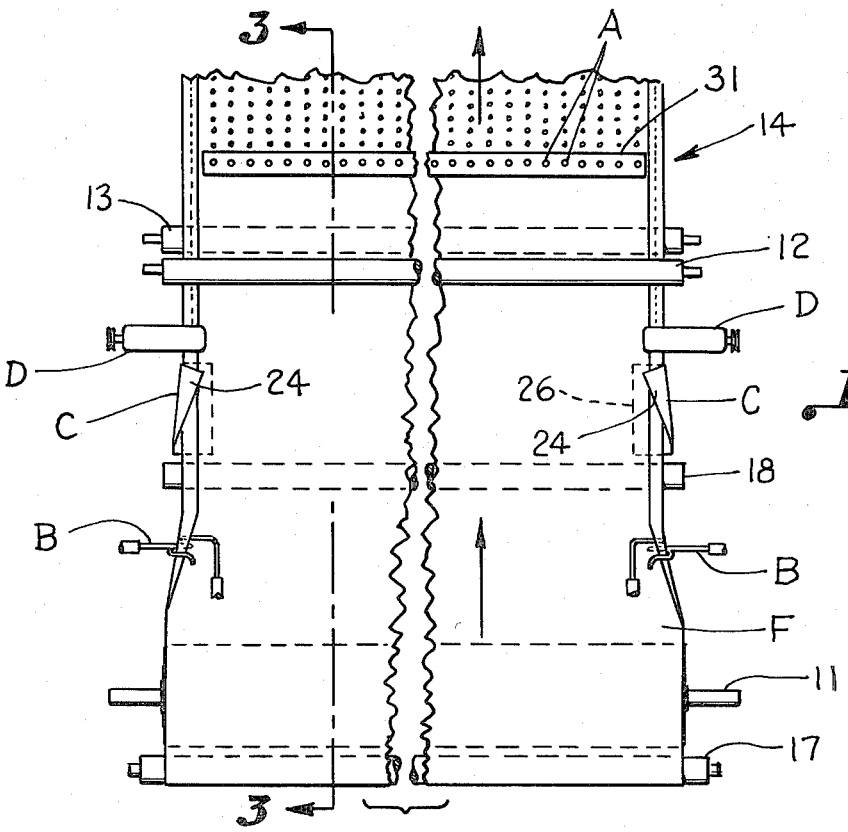
Fig. 2.

APPARATUS AND METHOD FOR REDUCING WASTE IN TUFTING

BACKGROUND OF THE INVENTION

An important object of this invention is to eliminate as much of the waste yarn created as a result of trimming the carpet to its finished width, usually 144" or 162" or 180", after a final manufacturing step such as lamination of the secondary backing or application of foam padding. Currently a manufacturer of tufted carpets and the like cannot rely on a consistent width of primary backing, usually woven polypropylene. For example, backing fabric received from suppliers for 144" carpet may be provided in a minimum width of 150". This minimum width is often controlled quite well but a very high proportion of backing may often vary to as much as 156" wide. This means that feelers and others with sensors such as those illustrated in U.S. Pat. No. 3,779,186 are relatively ineffective in properly presenting the backing to the needles of the tufting machine.

On each selvage there is a reinforcement for pinning of between ¾" and 1" wide. The weakness and porosity of this backing precludes the successful tenter frame dryer pinning anywhere other than in the reinforcement. Also, there is a variance in the backing width of an individual roll that is run on a give tufting machine. There is a width variation when the same style is run on another tufting machine, along with the lack of centering the tufting needles on the backing on any tufting machine that can make it virtually impossible for any operator to run a production lot from one or several tufting sources at the same density or frame width. This problem resulted in the necessity to tuft at least 1½" additional width, which is subsequently cut off prior to shipment in order to insure that a full width carpet will result.

Efforts to deal with the problem varying backing widths and lateral movements thereof with respect to the needles have included the provision of longitudinal chains with attached gripping means for engaging the side edge portions of the backing material for positively positioning the backing in proper lateral position as disclosed in U.S. Pat. No. 3,865,059. A later attempt to solve the problem has included the making of the waste or salvage portion which is trimmed away from low cost waste yarn rather than from first quality yarn used to produce the main or central portion of the carpet as described in U.S. Pat. No. 4,077,434. The use of a folded selvage for another purpose is illustrated in U.S. Pat. No. 3,848,435.

SUMMARY OF THE INVENTION

It has been found that a hemmer may be provided which will allow subsequent systems of conventional design to accurately locate the edge and simultaneously the first tuft on both selvages of the carpet, thereby eliminating a major portion of waste trim per linear yard of finished carpet produced. Prior to the backing entering the tufting needles, each selvage is folded over upon itself so that the new edge created is a predetermined distance from the first tufting needle. This distance is the same on each side.

After folding the backing is passed over tensioning rolls which tend to crease or iron the new edge along with moving the web from the vertical plane to the horizontal plane and thereby presenting the web edge to the joining device which is preferrably a sewing head.

The sewing head may be driven by one of several drive rolls on the tufting machine, thereby affording a drive so positive as to preclude needle breakage or puckering, which may result if separate drives were utilized. The same jack-shaft which runs one head through compound gearing may extend across the machine, under the web and through the same compound gearing, drive the other head simultaneously. If all of a carpet manufacturer's tufting machines are equipped with a hemmer, all subsequent guiding operations may be simplified. Pinning can be accomplished anywhere on the new wide edge because the folding and hemming create a lock between the warps and fillings, which are now adjacent each other. All but one line per side of extra tufts may be ultimately eliminated, because the use of conventional sensing means makes it possible to find the edge and hence the first tuft must be in proper predetermined position.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a schematic perspective view illustrating a tufting machine having apparatus constructed in accordance with the invention taking the variance out of a width of backing fabric being fed to the loop forming needles, FIG. 2 is a plan view of the apparatus of FIG. 1 illustrating folding apparatus for presenting a folded edge of backing material for stitching and thence in proper position for loop formation.

DESCRIPTION OF A PREFERRED EMBODIMENT

The drawings illustrate tufting apparatus having transversely disposed tufting needles A receiving backing fabric F fed thereto in open width. Folding apparatus receiving opposed edges of the backing fabric folding the edges inwardly to form opposed multi-layered selvages include first and second folding devices B and C respectively. Means securing the layers of respective multi-layered selvages together for reception of the backing fabric by the transversely disposed tufting needles includes a sewing machine D positioned at each edge of the backing material.

Thus, loops of tufted yarn may be formed in a width of the backing fabric between the multi-layered edges, whereby, it is unnecessary to trim away excess width portions of the loops. Preferrably a jack shaft E and the like is provided to simultaneously operate both sewing machines from a driven shaft of the tufting machine.

A roll of backing fabric 10 is illustrated as being wound on a suitable carrier shaft 11 which is positioned beneath the portion of the tufting machine receiving the backing which includes a pin roll 12 and carrier roll 13.

Figure 3:
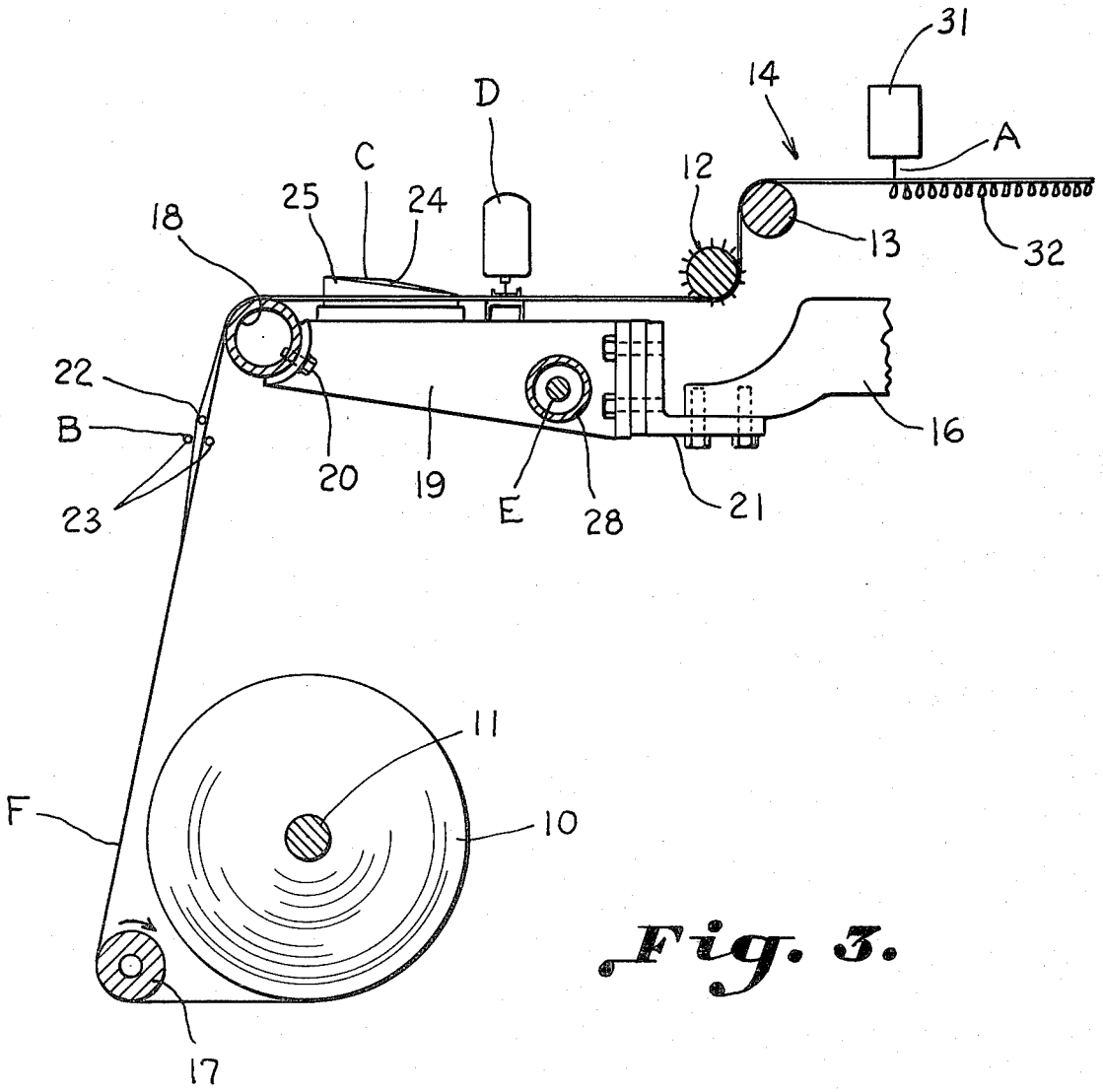
FIG. 3 is a transverse sectional elevation taken on the line 3—3 in FIG. 2.

The tufting machine is broadly designated at 14 and includes a frame 15 and machine bed plate 16, FIGS. 1 and 3.

Guiding means for directing the fabric in open width in a predetermined upward run preferrably includes a roll 17 carried forwardly and beneath the shaft or pin 11 to assure continuity or the same angle of attack of the width of backing to the tufting apparatus at all times. Such guiding means are further illustrated as including a roll 18 over which the fabric F passes on a predetermined horizontal run toward the tufting needles A.

The roll 18 is fastened near each end and at intermediate locations on a respective bracket 19 as by a bolt 20, FIG. 3. The brackets 19 are suitably secured to an angle 21 which in turn is carried by the machine bed plate 16 supported by the frame 15.

The fabric F in its upward run encounters the action of the pair of opposed folders B which are of the same type as the folding apparatus disclosed in U.S. Pat. No. 3,783,805, the disclosure of which is incorporated and made a part hereof by reference. It has been found that the open weave, flimsey fabric which is often constructed of flat synthetic material tends to run, under the conditions of feeding described herein, with varying tensions which go from a loose selvage to a tight selvage. It has been found that these conditions may best be met by utilizing spaced folding devices the first of which is a folder wherein the stop member 22 is positioned about an inch above and extending outwardly terminating just short, approximately ⅜ inches, of the junction of the inwardly extending fingers 23 of the turning in member. By making trial and error adjustments of the positioning of the elements of the folder optimum operating conditions may be achieved. Such a folder is especially useful in folding where fabric tension is high as in a tight selvage condition. If the selvage tends to be loose the fold tends to come out and a second folder is necessary, however, if the selvage tends to be tight the fabric will probably fold and remain folded as a result of the action of the first folder.

If folding is insufficiently achieved by the first folder a second opposed folding means C may be positioned on opposed sides of the lateral run for receiving the backing after it has passed over the guide roll 18. This second folding device is generally of the simple type having a higher profile at its entrance end and having an upper turned sheet metal portion 24. A side portion 25 tapers downwardly from the opening toward an exit end and a bottom 26 extends inwardly from a lower edge thereof beneath the backing material.

Thus, proper folding and positioning is assured for accurate presentment of the backing fabric to the needles in predetermined alignment so there is no necessity for tufting the extra width of fabric. Preferrably the fold is sewn so as to form a hem immediately after the backing fabric exits from the second folder. The sewing machines D are schematically illustrated is position on opposite sides of the lateral run of the backing for hemming and are supplied with thread from a package 27.

Figure 4:
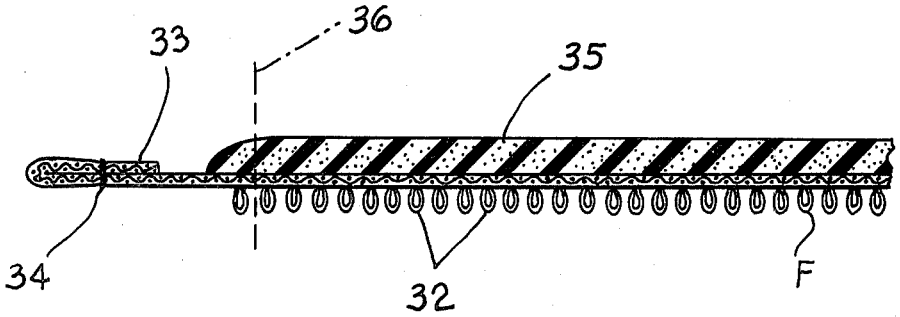
FIG. 4 is an enlarged sectional view of a tufted carpet illustrating the savings in waste trimmings achieved in accordance with the invention.

The sewing machines are driven simultaneously as by a jack shaft E carried in bearings 28 in the brackets 19. The jack shaft is driven by a chain 29 which may in turn be operated by a driven element of the tufting machine, such as the yarn feed drive shaft 30 for synchronously activating the sewing machines. The sewing machines or hemmers are each driven from the jack shaft as by a gear belt 29*a*. If desired the sewing machines may be equipped and driven as illustrated in U.S. Pat. No. 3,981,255 the disclosure of which is incorporated and made a part hereof by reference. The hemmed backing material then passes beneath the usual pin roll 12 and over the carrier roll to the needles A, at least one needle bar being schematically illustrated at 31. Loops 32 are formed by the action of the needles between the hemmed or folded portions illustrated at 33 in FIG. 4. The fold 33 is illustrated in FIG. 3 above the backing edge for forming together with the stitching 34 the hem and is on the opposite side of the backing as the loops, FIG. 4.

The usual urethane backing is illustrated at 35 and at least one row of loops may be trimmed away along the broken line 36. The thickened edges formed by the hemmed portions are readily received upon the pins of the tenter frame so that the usual thickened selvage provided by the manufacturer in such backing material may be omitted providing additional savings.

If desired auxiliary means including feeler switches and cloth guiding means acting responsive thereto may be employed. Variations upon the apparatus described herein may include the use of extra marginal tufting means including needles may be utilized to stitch the folded selvage portions to form the hems. Furthermore, in lieu of sewing of hems or selvage portions glueing, heat setting, fusing, sonic or other mechanical securement means may also be employed. In some instances where the primary backing possesses sufficient strength for securement for tentering in a single width, as where certain non-wovens are the primary backing fabric new edges may be formed by cutting means located at a predetermined position on each side of the moving backing always the same distance from the outboard tufting needle on both sides.

While a preferred embodiment of the invention has been described using specific terms, such description is for illustrative purposes only, and it is to be understood that changes and variations may be made without departing from the spirit or scope of the following claims.

What is claimed is:

1. The method of tufting reducing yarn waste comprising the steps of:

feeding a backing fabric lengthwise toward transversely disposed tufting needles;

folding at least one of the edges of said backing fabric inwardly to form a multi-layered edge;

positioning the layers of said multi-layered edge together for reception of a portion of said backing fabric inwardly of said multi-layered edge by said transversely disposed tufting needles;

forming loops of tufted yarn in said portion of said backing fabric inwardly of said multi-layered edge; and trimming away said edge of said backing fabric together with adjacent loops of tufted yarn;

whereby excess width portions of said loops are unnecessary.

2. The method set forth in claim 1 wherein said positioning includes securing the layers together by mechanical connection therebetween.

3. The method set forth in claim 2 wherein said securing includes sewing the layers together prior to reception of said backing by said needles.

4. The method set forth in claim 3 wherein said positioning includes creasing the backing fabric.

5. The method set forth in claim 1 including folding each of the opposed edges by successively presenting respective edges serially to spaced folding devices.

6. The method set forth in claim 5 including sewing the edges upon completion of said folding.

7. The method of making carpet material comprising the steps of:

folding the opposed edges of carpet backing fabric inwardly to form multi-layered edges;

thereafter securing the layers of said multi-layered edges together forming thickened selvage portions for reception of a portion of said backing fabric inwardly of said multi-layered edges by transversely disposed tufting needles;

forming loops of tufted yarn in said portion of said backing fabric inwardly of said multi-layered edges; and utilizing said thickened selvage portions for securement of opposed edges during tentering;

whereby excess width portions of said loops may be avoided.

8. The method set forth in claim 7 including securing the layers by sewing while feeding said backing fabric to said tufting needles after folding.

9. The method of tufting carpet material comprising the steps of:

feeding a backing material moving same lengthwise toward transversely disposed tufting needles;

locating an edge forming means at a predetermined position on each side of the moving backing material prior to reception thereof by the needles;

forming opposed edges on said backing material by said edge forming means so that the edges are always the same distance from an outboard tufting needle on both sides;

forming loops of tufted yarn in said backing material inwardly of said edges; and trimming away said edges of said backing material together with adjacent loops of tufted yarn forming finished carpet;

whereby excess width portions of said loops are unnecessary.

10. The method set forth in claim 9 wherein said opposed edges are formed by folding and hemming.

11. The method of tufting carpet material comprising the steps of:

locating an edge forming means at a predetermined position on each side of the moving backing material;

forming opposed edges on said backing material so that the edges are always the same distance from tufted loops on both sides;

forming loops of tufted yarn in said moving backing material inwardly of said edges;

utilizing said opposed edges for securement during tentering; and trimming away said edges of said backing material together with adjacent loops of tufted yarn forming finished carpet;

whereby excess width portions of said loops are unnecessary.

* * * * *